US008382449B2

(12) United States Patent
Pecorari

(10) Patent No.: US 8,382,449 B2
(45) Date of Patent: Feb. 26, 2013

(54) FLUID MACHINE WITH RADIAL CYLINDERS

(75) Inventor: Gabriele Pecorari, Modena (IT)

(73) Assignee: S.A.I. Societa' Apparecchiature Idrauliche SpA, Modena (IT)

( * ) Notice: Subject to any disclaimer, the term of this patent is extended or adjusted under 35 U.S.C. 154(b) by 917 days.

(21) Appl. No.: 11/630,826

(22) PCT Filed: Jun. 30, 2005

(86) PCT No.: PCT/IT2005/000375

§ 371 (c)(1),
(2), (4) Date: Oct. 9, 2008

(87) PCT Pub. No.: WO2006/003689

PCT Pub. Date: Jan. 12, 2006

(65) Prior Publication Data

US 2009/0060758 A1 Mar. 5, 2009

(30) Foreign Application Priority Data

Jun. 30, 2004 (IT) ..... MO2004A0165

(51) Int. Cl.
*F04B 1/04* (2006.01)
*F04B 27/04* (2006.01)

(52) U.S. Cl. ..... 417/273; 91/491; 92/168

(58) Field of Classification Search ..... 417/269, 417/273; 91/491, 503, 6.5, 223; 92/72, 165 R, 92/168, 233; 277/434
See application file for complete search history.

(56) References Cited

U.S. PATENT DOCUMENTS 2,678,005 A * 5/1954 Messick ..... 417/523
2,795,195 A * 6/1957 Amblard et al. ..... 417/572
3,312,149 A * 4/1967 Fleckenstein et al. ..... 92/170.1
3,412,647 A * 11/1968 Paschke ..... 91/476

(Continued)

FOREIGN PATENT DOCUMENTS

DE 2 244 920 4/1974
DE 24 58 430 6/1976

(Continued)

OTHER PUBLICATIONS

European Office Action dated May 21, 2010.

(Continued)

*Primary Examiner* — Devon Kramer
*Assistant Examiner* — Amene Bayou
(74) *Attorney, Agent, or Firm* — McGinn IP Law Group, PLLC

(57) ABSTRACT

A fluid machine with radial cylinders, includes cylinders being fixed with respect to a body wherein the cylinders are peripherally spaced in a rotation plane of a crank rotating with a driving shaft of the machine, elements distributing a fluid, a piston of each cylinder placed in contact with a surface of the crank by a sliding member, the piston of each cylinder being placed within a jacket of the cylinder with contact of a side surface of the piston in a guide and sealing area which is small with respect to the side surface of the piston, and for a guide function an annular edge is present and projecting from an inner surface of the jacket, and for a sealing function a sealing ring is present on the jacket and housed in an annular slot which is parallel and attached to the annular edge, and rings maintaining the contact between the pistons and the crank.

26 Claims, 3 Drawing Sheets

U.S. PATENT DOCUMENTS

Figure 2:
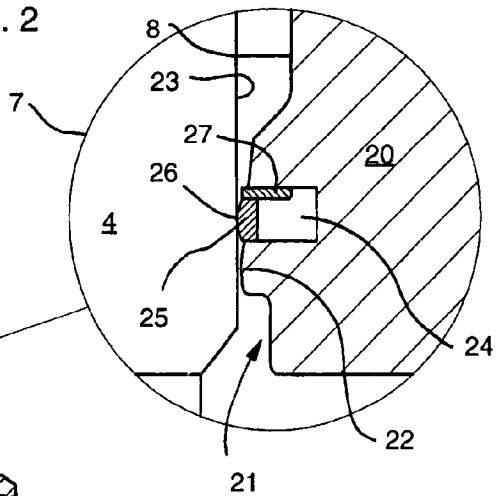

| | | | | | |
|---|---|---|---|---|---|
| 3,548,721 | A | * | 12/1970 | Eisennegger | 92/153 |
| 3,695,150 | A | * | 10/1972 | Salzmann | 92/169.1 |
| 3,716,310 | A | * | 2/1973 | Guenther | 417/552 |
| 3,799,034 | A | * | 3/1974 | Haglund et al. | 91/490 |
| 3,874,275 | A | * | 4/1975 | Cunningham et al. | 92/248 |
| 3,899,957 | A | * | 8/1975 | Carlson et al. | 91/490 |
| 3,945,766 | A | * | 3/1976 | Gelon | 417/273 |
| 3,968,736 | A | | 7/1976 | Pecorari | |
| 4,144,799 | A | * | 3/1979 | Ponchaux | 91/488 |
| 4,413,486 | A | * | 11/1983 | Irwin | 60/39.63 |
| 4,594,059 | A | * | 6/1986 | Becker | 417/439 |
| 4,637,295 | A | * | 1/1987 | Powers et al. | 92/170.1 |
| 4,913,628 | A | * | 4/1990 | Samland et al. | 417/273 |
| 5,079,994 | A | * | 1/1992 | Berbuer | 91/491 |
| 6,224,352 | B1 | | 5/2001 | Hauser et al. | |
| 2004/0037710 | A1 | * | 2/2004 | Stewart et al. | 417/273 |

FOREIGN PATENT DOCUMENTS

| | | | |
|---|---|---|---|
| DE | 27 31 497 | B2 | 1/1979 |
| DE | 101 23 038 | A1 | 11/2002 |
| EP | 0 538 637 | A1 | 4/1993 |
| EP | 1 022 468 | A2 | 7/2000 |
| FR | 1380335 | | 1/1964 |
| FR | 2 822 199 | A1 | 9/2002 |
| GB | 1 437 943 | | 6/1976 |
| WO | WO 97/09532 | | 3/1997 |
| WO | WO 99/17021 | | 4/1999 |

OTHER PUBLICATIONS

European Office Action dated May 13, 2009.

* cited by examiner

FLUID MACHINE WITH RADIAL CYLINDERS

The invention concerns: an improved fluid machine with radial cylinders, i.e. a machine with radial cylinders fixed to its own sump, advantageously for fluids under pressure, wherein each piston is coupled to its own cylinder so as to reduce the coupled parts, to reduce the overall dimensions and to clearly improve the mechanical performances of the machine.

The state of the art, in the specific field of the machines with radial cylinders, comprises the hydraulic motors with cylinders oscillating with respect to the body of the motor and with fixed cylinders; these latter have connection elements of the crank with the piston, such as connecting rods, sliding surfaces of the piston base or sliding pads of the piston body on the crank.

On the other hand, all the above said hydraulic machines, for the parts employed, have considerable dimensions having to house, between the cylinders and the crank of the parts, such as the connecting rods, said sliding surfaces and the pads which, due to their presence, oblige to remarkably enlarge the dimensions of the machine, being the displacement equal. Thus, the cylinder head is normally realised with the arrangement of a plug or cap clamped with threads or screw crowns on diameters being greater than the diameter of the jacket, further increasing the machine dimensions.

Moreover, distributors known in the art are, for the hydraulic machines with radial cylinders, centred on their inner diameter and guided in rotation by a prismatic coupling with the driving shaft, they have a chain of allowances which, during the mounting, generates higher angular clearances on the distributor; therefore, the mounting generates anomalous wears on the port disk and makes it difficult the correction of the precession or advance of the distributor sometimes necessary for a correct operation of hydraulic machines for specific uses.

The state of the art further provides, as described in German Patent Application DE 10123038 Al, pistons of a piston pump . guided in the reciprocate movement into its jacket by a guiding ring and a seal ring put together in a annular seat near the end of the jacket before the eccentric of the crank shaft. The seat have a conical form to the guiding ring and the extrusion of the seal ring is prevented at high pressure also.

Such state of the art is liable to remarkable improvements as regards the possibility of carry out a machine for fluids which allows a simple construction, has a reduced number of parts and overcomes the above drawbacks.

As from the above, there derives the need of solving the technical problem of realising: a machine with radial cylinders for fluids wherein between the crank and the cylinders a reduced number of parts are present; moreover, which allows, being the displacement equal, to realise reduced dimensions with respect to the. known types; finally, which enable to realise high performances to allows the use as motor with pickup obtained at a very low pressure gradient.

The invention solves the above said technical problem by adopting: a fluid machine with radial cylinders, comprising cylinders being fixed with respect to the body wherein the cylinders are peripherally spaced in the rotation plane of a crank rotating with a driving shaft of the machine; elements distributing the fluid; a piston of each cylinder placed in contact with the surface of said crank through sliding means and arranged within a jacket of the cylinder with contact of the side, or side surface, of the piston in a restricted guide and sealing area; for the guide function an annular edge is present projecting from the inner surface of the jacket; for the sealing function a sealing ring is present close to the guide edge on the jacket and housed in a annular slot associated with the guide edge; characterised in that it comprises elements for maintaining the contact between the pistons and the crank to allow oscillation of the piston within the jacket on the rotation plane of the crank, according to the position of the sliding means on the crank.

By adopting, even more, in a further embodiment: the guide and sealing area placed near the top of the jacket next to the head or placed near the jacket base next to the crank.

By adopting, moreover, in a further embodiment: the guide edge of the guide and sealing area placed on the side under pressure of the sealing ring or placed to prevent the pressure of the fluid on the guide edge.

By adopting, even more, in a further embodiment: a decomposable containment slot of the sealing ring.

By adopting, moreover, in a further embodiment: the sealing ring housed in the annular slot by means of a containment resting ring.

By adopting, even more, in a further embodiment: the side surface, or side, of the piston in contact with the sealing ring equipped with slightly concave conformation.

By adopting, moreover, in a further embodiment, the metallic sealing ring, or of elastomer.

By adopting, even more, in a further embodiment: the sealing ring equipped with conformed inner sealing surface.

By adopting, moreover, in a further embodiment: a cylinder head mounted inside the jacket and equipped with anti-ejection edge.

By adopting, even more, in a further embodiment: the head equipped with convex crown and having, accordingly, the pistons equipped with concave crown.

By adopting, moreover, in a further embodiment: the pistons equipped with sliding means made of a friction pad for each piston.

By adopting, even more, in a further embodiment: the pad rigidly connected, under construction, with the piston body.

By adopting, moreover, in a further embodiment: the pistons being hollow and closed.

By adopting, even more, in a further embodiment: the hollow pistons realised with a cap tightly applied onto a hollow body of the single piston.

By adopting, moreover, in a further embodiment: the hollow pistons realised with an adduction small tube of the fluid to lubricate the pad.

By adopting, finally, in a further embodiment: to constitute said distribution elements, a rotating distributor placed in synchronous rotation with the driving shaft by means of a dragging pivot having prismatic coupling with the distributor and cylindrical coupling with negative allowance at the driving shaft.

Figure 1:
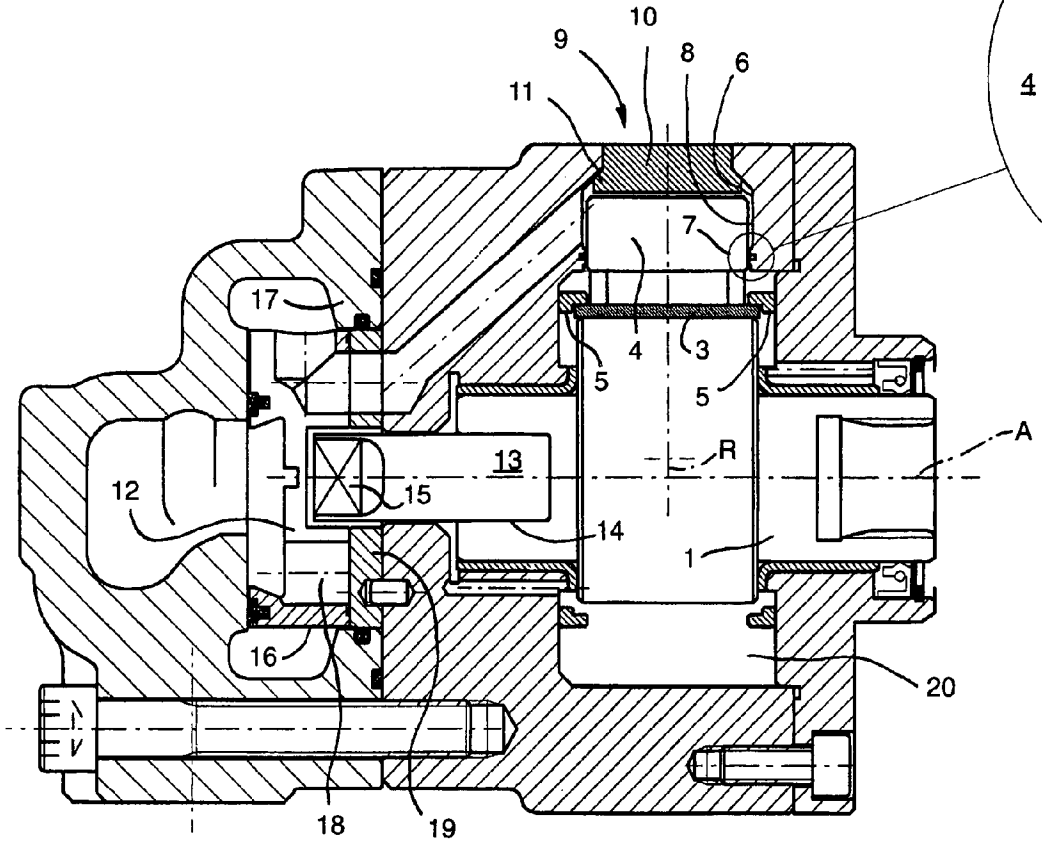
Figure 3:
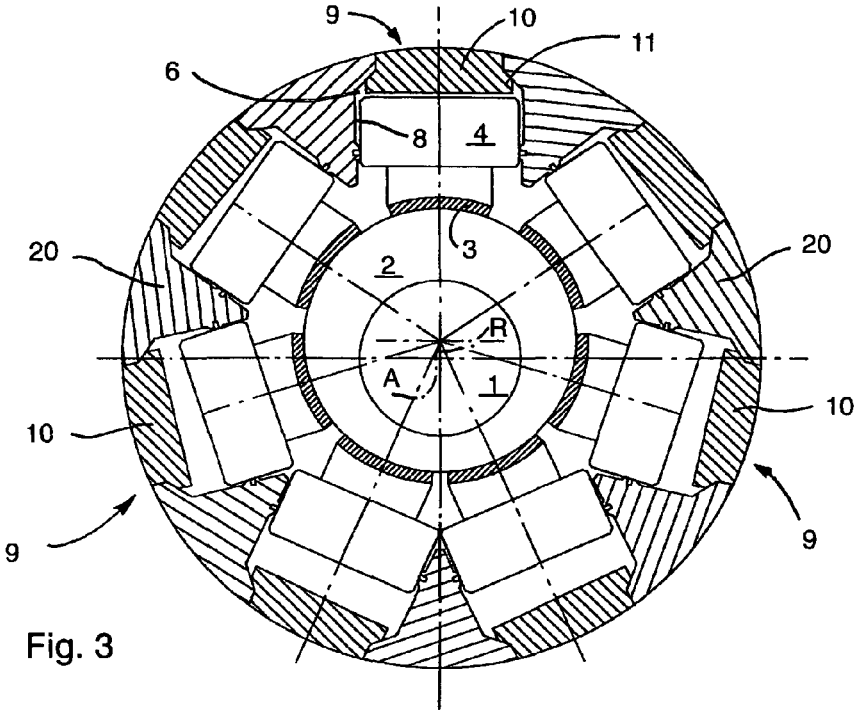
Figure 4:
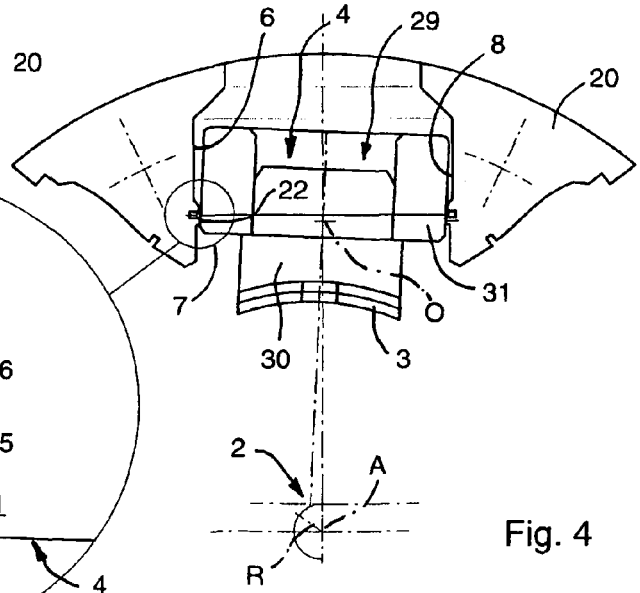
Figure 5:
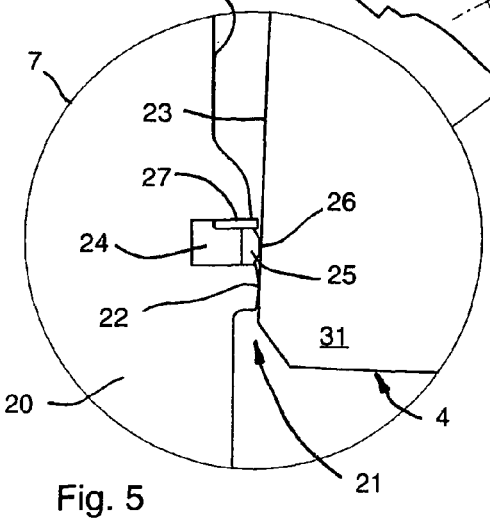
Figure 6:
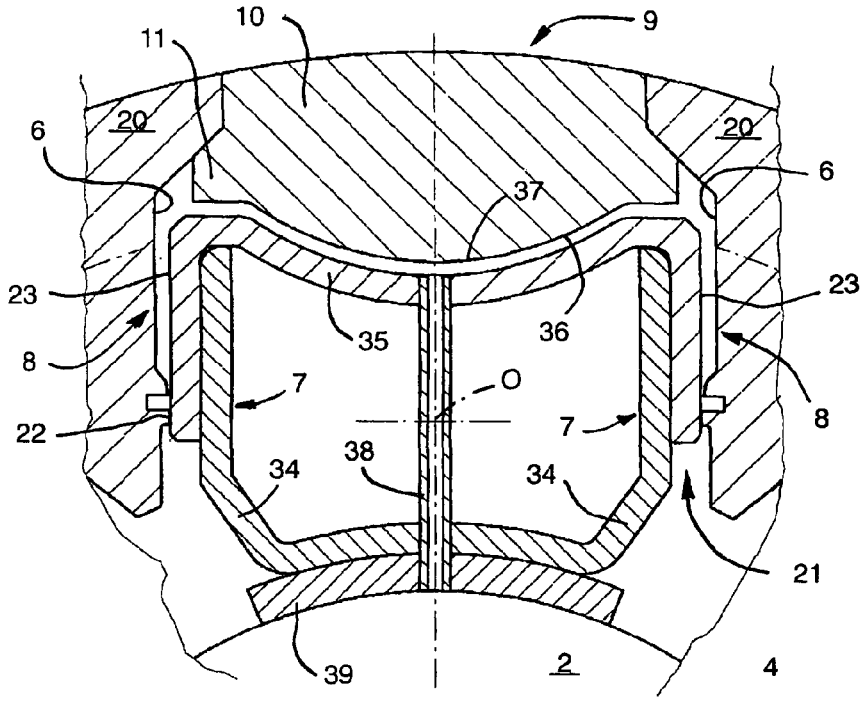
Figure 8:
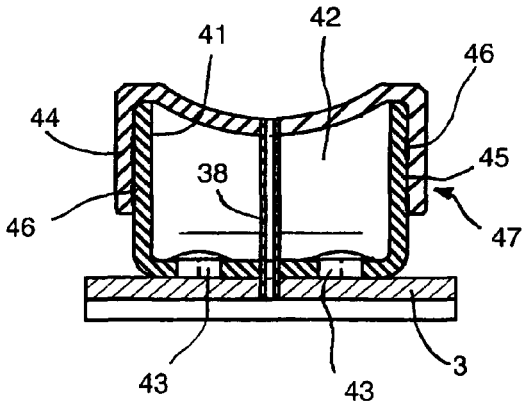
Figure 7:
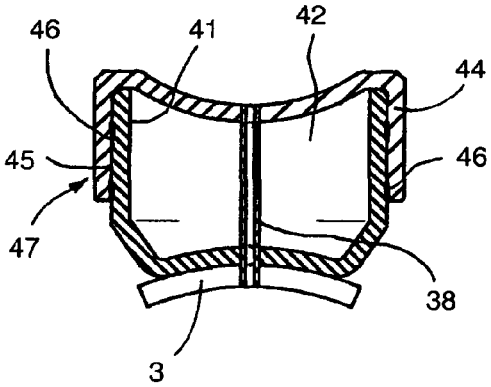

A mode to carry out the invention is shown, by way of mere example, in the three annexed drawing tables wherein FIG. 1 is the section of a hydraulic motor realised according to the invention; FIG. 2 is the enlarged section of the detail of the sealing on the piston side against the cylinder jacket; FIG. 3 is the scheme of a machine equipped with seven radial cylinders and pistons according to the invention; FIG. 4 is the scheme of a cylinder with the piston moved from the top dead centre; FIG. 5 is the enlargement of the detail of the sealing between the piston and the jacket in the position of FIG. 4; FIG. 6 is the schematic view of a hollow piston within the jacket wherein the conformation of the cylinder head suitable to reduce the residual clearance volume can be seen; FIGS. 7 and 8 are longitudinal and transversal sections at the rotation axis of the driving shaft of a hollow composite piston.

FIG. 1 shows a driving shaft 1 on the axis A equipped with crank 2 having radius R; on the crank pads 3 of the pistons 4 slide held against the cylindrical surface of the crank by the rings 5; the piston is mobile within a jacket 6 which has a single guide and sealing area 7, whereas the upper part of jacket 8 is shaped with a very wide diameter with respect to the diameter of the piston; to close a cylinder 9 on top a head 10 is present with anti-ejection edge 11 inside the jacket itself, being advantageously realised with frustum-of-cone-like seat, the head is advantageously curve to resist against the stresses and contain possible flexures. A rotating distributor 12 is connected to the driving shaft 1 by means of a dragging pivot 13 coupled with negative allowance 14 on the shaft 1 and connected by means of a prismatic coupling 15 with radial centring; an external diameter 16 of the distributor is not in contact with the body 17. In the rotation motion of the distributor the adduction ports 18 of the fluid little by little faced corresponding ports on a disc 19 fixed to the sump 20 of the motor.

FIG. 2 shows, moreover, a lower end of the jacket 21 whereon the guide edge 22 is made on the side 23, or side surface, of the piston 4; on top of the guide edge, in the guide and sealing area 7, an annular slot 24 is realised to house a sealing ring 25, equipped with inner surface 26 and guided from the upper side, opposite to the side of the guide edge 22, by a containment resting ring 27 of the ring within the slot. The inner surface 26 of the ring in contact with the side of the piston can have conformation suitable even according to the clearance or negative allowance between them.

FIG. 4 shows a composite piston open on top 29 wherein, on a trunk 30, rigidly connected to the pad 3, a ring 31 having the diameter outside the piston 4 is keyed with negative allowance. FIG. 4 clearly shows the oscillation motion of the piston 4 within the jacket 6 around an oscillation axis O, intersection of the radial plane at the axis A, containing the axis of the jacket 6, with the plane containing said guide edge 22. The slot 24 is advantageously realised near the guide edge 22 to minimise the effects of the oscillation in the sealing ring 25.

FIG. 6 shows a conformation of the piston 4 of the hollow type 34 applied to the pad 3; here with the crown 35 of the concave piston to couple itself to a jacket 36 crown, made on the inner wall 37 of the head 10, to reduce the remaining clearance volume. The jacket can has also a remarkably greater diameter with respect to the diameter of the piston, increasing however the clearance volume in the cylinder. The hollow piston 34 has, moreover, a lubrication small tube 38 of a pad 39 through the small tube; the use of the small tube allows a lightened construction of the piston and it avoids, in the presence of hollow piston, that the possible lubrication fluid of the pad 39 fills the hollow piston in, thus realising a big clearance volume or localising an inert mass in motion with the piston.

FIGS. 7 and 8 show the parts constituting a piston to realise by composition of a body 41, hollow 42 on top, whereto the pad 3 is applied with rivets 43, pins or other. The piston is closed on top by a cap 44 with the external diameter being equal to the diameter of the piston and inner diameter 45 coupled with negative allowance to the external diameter of said body 41, to ensure the sealing and avoid the unthreading from the body. In the coupling between the cap 44 and the body 41 light thickness rims 46 are advantageously provided so as to allow a quick mounting limiting the surface to be worked with restricted tolerance for the coupling in the annular bands of the thickness rims. The adoption of the thickness rims 46 allows to realise when mounting the cap 44 a light concavity 47 in the side of the piston, when the wall of the cap is thin and deformable, so as to decrease the stress in the sealing ring 25 during the piston oscillations.

The operation of the machine for fluids with radial cylinders according to the invention occurs as follows, in the case described and shown of hydraulic motor.

The alternative motion of the piston 4 within the jacket 6 occurs with the oscillation of the piston itself within the jacket, which remains fixed to the sump 20 of the motor. The piston moves according to the position of its own pad 3 on the crank 2 of the driving shaft 1. The radius R of the crank, as effect of the rotation, determines the oscillation of the piston 4 axis with respect to the jacket 6 axis around the point O, intersection of the containment plane of the guide edge 22 with the axis of the cylinder 9 jacket. Said oscillation is made possible for the remarkable diameter given to the jacket outside the guide and sealing area 7 between the jacket and the piston. In order to perform the sealing of the fluid in the jacket 6 the ring 25 is slidingly coupled onto the diameter of the cylinder 4 and in turn held within the annular slot 24 of the resting ring 27. The resting ring and the guide edge 22 have a diameter with light clearance with respect to the cylinder diameter to allow the oscillation of the piston 4 diameter, having pivot exactly on the guide edge. During the oscillation the ring 25 results to be constrained within the slot 24 and therefore it is subjected to the projection of the piston diameter on the surface of the slot itself, obliging the sealing ring to adequate its own shape to the shape of the intersection of the side surface of the piston 23, or side, with the slot surface, since the piston is inclined with respect to the jacket axis, coinciding with the direction perpendicular to the slot surface. The clearance, instead, within the diameter of the piston with the guide edge 22 and also with the resting ring 27 allows the light increase of the circumference of the diameter projection on the plane of the resting ring and of said guide edge. The sealing ring 25, advantageously metallic, absorbs, with the extension, the increase of peripheral development remaining in contact with the piston surface 4. The thin dimension of the ring allows its extension so as the light difference of inner/external diameter easy its mounting within said slot 24 together with the resting ring 27, which, for the best operation, must be placed on the side of the fluid under pressure. The guide edge 22 is placed close and in parallel to said annular slot 24 so as to reduce the oscillation and the deformation of the sealing ring 25 within the slot to the minimum. The closeness of the slot 24 to the guide edge 22 reduces the lateral translation of the sealing ring within the slot. The lateral thrusts of the piston on the jacket are transmitted only by the contact of the side of the piston 23, or side surface, against the guide edge 22. Therefore, major advantages derive if the guide edge has been subjected to surface hardening treatment.

The sliding coupling between the sealing ring 25 and the side of the piston 23 is with clearance or negative allowance compatibly with the resistance against the sliding being acceptable for the specific use of the fluid machine.

From tests carried out it has been noted that it is convenient to realise the side surface 23, or piston side, in the area in contact with the sealing ring 25 with a concavity, performing a so called "long" grinding to avoid that the sealing ring jumps during sliding on edges due to the working.

In the distributor 12, the phase can be changed at will during the mounting, registering the position of the insertion with negative allowance of said pivot 13 in the driving shaft 1, thus realising the variation of the angle on the prismatic coupling 15 and, in consequence, of the rotating distributor 12.

The distributor of the machine with radial cylinders can conveniently be of different type than what has been shown, such as of the orbiting type, so as to allow the crossing of the distributor area with an end of the driving shaft 1; finally, in machines for gaseous fluids the distribution could be with valves, slide or sleeve valves also.

The advantages obtained by this invention are: the possibility of reducing the overall dimensions of the fluid machine with radial cylinders, maintaining a high displacement so as to achieve high powers. In fact, between the crank and the cylinders a very small number of parts are interposed, this allows to use all the available volume for the main elements, the crank and the piston; the construction of the cylinder is extremely reduced with the reduction to one single contact edge between the piston and the jacket, the working thereof results to be extremely reduced; the construction of the cylinder head is realised by introducing therein the head from the inside so as to avoid the ejection of the head by means of retention edge 11; the head and the crown of the piston can be advantageously shaped to reduce the residual clearance volume, which is usually high in hydraulic machines. The piston guide in the jacket is simplified and the closeness between the sealing ring and the guide edge of the piston in the jacket reduces the translations induced onto the sealing ring to the minimum value, as effect of the oscillation of the piston within the jacket. Moreover, the material of the sealing ring 25 can be also plastics or rubber, besides metallic, allowing the use with different types of fluids. Even more, the sealing ring can be mounted also devoid of containment resting ring if adequately inserted in the annular slot. Finally, the light concavity of the side 23, or side surface of the piston allows an adaptation to the sealing ring 25 at the exact projection imposed in the inclination of the side on the containment plane of the guide edge 22. A further and significant advantage lies in the construction of the machines with radial cylinders with very low ratio between stroke and diameter of the piston; in fact, it is possible to maintain it below 0, 3 with unquestionable advantages in the construction of motors realising a so called "super-square" dimensioning, thus minimising the kinetic energy interested in the piston motion. Finally the further adoption of rolling friction bearings on the bank pivots of the driving shaft and in the contact between the crank 2 and the pads 3, 39 by means of the interposition of a ring and of a bearing as known in the art, allows to further reduce the frictions remarkably increasing the mechanical performance of the fluid machine.

In the practical actuation the materials, the dimensions, the executive details can be different from those indicated, but technically equivalent thereto, without for this reason departing from the juridical domain of the present invention. Thus, the fluid machine can be realised with more than a crown of radial cylinders.

The invention claimed is:

1. A fluid machine with radial cylinders, comprising:

cylinders being fixed with respect to a body wherein the cylinders are peripherally spaced in a rotation plane of a crank rotating with a driving shaft of the machine;

elements distributing a fluid;

a piston of each cylinder placed in contact with a surface of said crank by a sliding member, the piston of each cylinder being placed within a jacket of the cylinder;

a guide and sealing area which is formed on the jacket and is small with respect to the side surface of the piston, the guide and sealing area comprising an annular edge projecting from an inner surface of the jacket; and a sealing ring formed on the jacket and housed in an annular slot which is parallel and attached to the annular edge; and rings maintaining the contact between the pistons and the crank, wherein the piston moves according to a position of the sliding member on the crank, and a radius of the crank, as an effect of rotation of the crank, determines an oscillation of an axis of the piston with respect to a radial axis that bisects the jacket and wherein the oscillation occurs around a point of intersection of a containment plane of the annular edge with the axis of the jacket.

2. The fluid machine, according to the preceding claim 1, wherein the guide and sealing area is placed close to the top of the jacket near a head of the cylinder.

3. The fluid machine, according to the preceding claim 1, wherein the guide and sealing area is placed near a lower end of the jacket next to the crank.

4. The fluid machine, according to claim 2, wherein the annular edge, of the guide and sealing area, is placed on a side of the sealing ring which is under pressure of the fluid.

5. The fluid machine, according to claim 2, wherein the sealing ring, of the guide and sealing area, is placed to prevent pressure of the fluid acting on the annular edge.

6. The fluid machine, according to claim 1, wherein the sealing ring is housed in the annular slot by means of a containment resting ring.

7. The fluid machine, according to claim 1, wherein the sealing ring is equipped with slightly concave conformation.

8. The fluid machine, according to claim 1, wherein the sealing ring comprises metal.

9. The fluid machine, according to claim 1, wherein the sealing ring comprises elastomer.

10. The fluid machine, according to claim 1, wherein an inner surface of the sealing ring projects from the annular slot toward a side surface of the piston.

11. The fluid machine, according to claim 1, wherein a head of the cylinder is formed inside the jacket and equipped with anti-ejection edge.

12. The fluid machine, according to the preceding claim 11, wherein the anti-ejection edge comprises a frustum-of-cone-like seat.

13. The fluid machine, according to the preceding claim 11, wherein the head is equipped with a convex crown.

14. The fluid machine, according to claim 1, wherein the pistons are equipped with a concave crown.

15. The fluid machine, according to claim 1, wherein the sliding member comprises a friction pad formed on each piston.

16. The fluid machine, according to the preceding claim 15, wherein the pad is rigidly connected, under construction, to a body of the piston.

17. The fluid machine according to claim 15, wherein the pad slides on a ring coupled to the crank by means of a rolling friction bearing.

18. The fluid machine, according to claim 15, wherein the pistons comprise hollow and closed pistons.

19. The fluid machine, according to the preceding claim 16, wherein the pistons comprise a hollow portion and a cap which is tightly applied onto the hollow portion of each of the pistons.

20. The fluid machine according to the preceding claim 18, wherein the pistons comprise a hollow portion and a fluid communication tube to lubricate the pad.

21. The fluid machine according to claim 1, wherein the annular edge comprises a hardness treated surface.

22. The fluid machine according to claim 1, further comprising:

a rotating distributor placed in synchronous rotation with the driving shaft by means of a dragging pivot including a prismatic coupling with the distributor and cylindrical coupling with negative allowance at the driving shaft.

23. The fluid machine according to claim 1, wherein the piston is configured to reciprocate and oscillate within the jacket.

24. The fluid machine according to claim 1, wherein the piston is configured to reciprocate and oscillate in a working movement within the jacket.

25. The fluid machine according to claim 1, wherein the jacket is rigidly connected to the body of the machine.

26. A fluid machine, comprising:

a driving shaft and a crank rotating with the driving shaft;

a plurality of cylinders which are peripherally spaced in a rotation plane of the crank;

a jacket formed in each cylinder, the jacket comprising:

an annular edge projecting from an inner surface of the jacket; and an annular slot formed adjacent to the annular edge;

a sealing ring formed in the annular slot of the jacket;

a piston located in the jacket of each cylinder and including a sliding member which contacts a surface of the crank, a side surface of the piston contacting the sealing ring, wherein the piston moves according to a position of the sliding member on the crank, and a radius of the crank, as an effect of rotation of the crank, determines an oscillation of an axis of the piston with respect to a radial axis that bisects the jacket and wherein the oscillation occurs around a point of intersection of a containment plane of the annular edge with the axis of the jacket.

* * * * *